US009667018B2

(12) United States Patent
Liu et al.

(10) Patent No.: US 9,667,018 B2
(45) Date of Patent: May 30, 2017

(54) PROTECTIVE CAP FOR RADIO-FREQUENCY CONNECTOR AND APPLICATION METHOD OF PROTECTIVE CAP

(71) Applicant: CommScope Technologies LLC, Hickory, NC (US)

(72) Inventors: Jin Liu, Suzhou (CN); Jianping Wu, Suzhou (CN); Li Zhang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/184,600

(22) Filed: Jun. 16, 2016

(65) Prior Publication Data

US 2016/0372883 A1 Dec. 22, 2016

(30) Foreign Application Priority Data

Jun. 19, 2015 (CN) ..... 2015 1 0345368

(51) Int. Cl.

| | |
|---|---|
| ***H01R 43/26*** | (2006.01) |
| ***H01R 24/40*** | (2011.01) |
| ***H01R 13/207*** | (2006.01) |
| ***H01R 13/64*** | (2006.01) |
| ***H01R 13/443*** | (2006.01) |

(52) U.S. Cl.

CPC ..... *H01R 43/26* (2013.01); *H01R 13/207* (2013.01); *H01R 13/443* (2013.01); *H01R 13/64* (2013.01); *H01R 24/40* (2013.01)

(58) Field of Classification Search

USPC ..... 439/148

See application file for complete search history.

(56) References Cited

U.S. PATENT DOCUMENTS 4,258,970 A * 3/1981 Bourdon ..... H01R 13/443 439/148
5,435,736 A * 7/1995 McMills ..... H01R 13/6397 439/133
6,309,246 B1 * 10/2001 Keaton ..... H01R 13/447 333/125

(Continued)

FOREIGN PATENT DOCUMENTS

JP 2002-023009 A 1/2002

OTHER PUBLICATIONS

International Search Report and Written Opinion Corresponding to International Application No. PCT/US2016/037824; Date of Mailing: Sep. 27, 2016; 11 Pages.

*Primary Examiner* — Alexander Gilman
(74) *Attorney, Agent, or Firm* — Myers Bigel, P.A.

(57) ABSTRACT

The present invention discloses a protective cap for a radio-frequency connector. The radio-frequency connector comprises a plug connecting piece and a socket connecting piece, wherein the protective cap can be removably mounted to the socket connecting piece for protection. The protective cap comprises a protection part structured to engage with the socket connecting piece and an inspection part structured to only allow a matched plug connecting piece to be inserted in. Hence, the inspection part can be used for inspecting the specific type of the plug connecting piece. The present invention further discloses an application method of the protective cap.

15 Claims, 3 Drawing Sheets

(56) References Cited

U.S. PATENT DOCUMENTS

| | | | | |
|---|---|---|---|---|
| 6,922,888 | B2 * | 8/2005 | Barry | H01R 13/62933 29/244 |
| 7,113,679 | B2 * | 9/2006 | Melton | G02B 6/4471 385/103 |
| 7,146,090 | B2 * | 12/2006 | Vo | G02B 6/387 385/138 |
| 7,270,487 | B2 * | 9/2007 | Billman | G02B 6/3846 385/55 |
| 7,287,992 | B2 * | 10/2007 | Chawgo | H01R 13/447 439/135 |
| 7,798,829 | B2 * | 9/2010 | Fong | H01R 13/443 439/148 |
| 7,802,472 | B1 * | 9/2010 | Richer | G01D 11/245 73/431 |
| 7,857,647 | B2 * | 12/2010 | Bracci | H01R 13/5205 439/274 |
| 7,914,306 | B1 * | 3/2011 | Blackwell | H01R 13/5213 439/135 |
| 8,257,106 | B2 * | 9/2012 | Fornage | H01R 13/639 439/304 |
| 9,069,026 | B1 * | 6/2015 | Rutkowsky | G01R 31/00 |
| 9,239,441 | B2 * | 1/2016 | Melton | G02B 6/3887 |
| 9,490,590 | B2 * | 11/2016 | Pari | H01R 13/6683 |
| 2007/0099456 | A1 | 5/2007 | Chawgo | |
| 2009/0124122 | A1 | 5/2009 | Stanford et al. | |
| 2009/0148104 | A1 * | 6/2009 | Lu | G02B 6/3816 385/72 |
| 2012/0315808 | A1 | 12/2012 | Millard | |

* cited by examiner

PROTECTIVE CAP FOR RADIO-FREQUENCY CONNECTOR AND APPLICATION METHOD OF PROTECTIVE CAP

RELATED APPLICATION

The present application claims priority from and the benefit of Chinese Patent Application No. 2015103453686, filed Jun. 19, 2015, the disclosure of which is hereby incorporated herein in its entirety.

FIELD OF THE INVENTION

The present invention relates to a protective cap for a radio-frequency connector and in particular relates to a protective cap for a small-Din type (Mini-Din type) radio-frequency connector. The present invention also relates to an application method of the protective cap of the above type.

BACKGROUND OF THE INVENTION

A radio-frequency device connector (radio-frequency connector) for communication equipment is an electromechanical component for connecting a conductor (wire) with an appropriate matched device so as to realize connection and disconnection of microwave signals. As an indispensable component in a passive device, there can be varied forms and structures of the radio-frequency connector, and various radio-frequency connectors in different forms can be chosen according to different application objects, frequencies, powers, application environments and the like.

In mobile communication engineering, two types of radio-frequency connectors, namely an N type radio-frequency connector and a Din type radio-frequency connector, are frequently used, wherein the N type radio-frequency connector is suitable for being used as a medium power or low power coaxial cable connector with a threaded connection mechanism. Compared with the N type radio-frequency connector, the Din type radio-frequency connector is capable of bearing a higher input power, and thus is generally used in high-power application occasions, for instance, a radio-frequency output port of a "macro" base station. The Din type radio-frequency connector usually includes two parts, namely, a plug (male) connecting piece and a socket (female) connecting piece.

A small-Din type radio-frequency connector, also called a Mini-Din type connector, is a frequently used Din type radio-frequency connector. According to different sizes of connecting interfaces, the small-Din type radio-frequency connectors also can be divided into 4.1/9.5 type and 4.3/10.0 type radio-frequency connectors.

The 4.1/9.5 type radio-frequency connector, which had been established as the standard (IEC60169-11) by the International Electrotechnical Commission (IEC) in 1977, is a radio-frequency connector first developed and practically applied to a communication system, and is mainly used in base station antennas.

In a mobile communication system, passive intermodulation (PIM) is gradually becoming a major reason of interference. PIM is produced when powers of radio-frequency signal with two or more frequencies simultaneously appear in a passive device; such PIM is a mixed signal produced due to a nonlinear characteristic of connection of heterogeneous materials, wherein one representative mixed signal is called a third-order intermodulation signal. PIM may interfere with a receiver, and may enable the receiver to be unable to work normally in a severe case; hence, it is crucial to suppress intermodulation interference.

With the development of the mobile communication technology, PIM performance must pass increasingly high requirements. In 2014, the major global radio-frequency connector manufacturers derived and developed a new small-Din type connector on the basis of the existing 4.1/9.5 type connector; the new small-Din type connector is named as the 4.3/10.0 type connector and also applied to antennas.

Hence, during the upgrading of the existing antennas, the two small-Din type connectors of different interfaces certainly may coexist for a while. In a practical mounting process, as the two interfaces are substantially similar in shape, and particularly the plug (male) connecting pieces substantially have no difference in their shapes, mounting personnel is apt to confuse the connectors of the two ports and carry out wrong mounting due to inaccurate distinguishment: namely, the mounting personnel may assemble the 4.1/9.5 type plug (male) connecting piece to the 4.3/10.0 type socket (female) connecting piece to cause damage to the port of the 4.3/10.0 type socket (female) connecting piece, thereby leading to scrapping of an antenna.

SUMMARY

One purpose of embodiments of the present invention is to provide a protective cap having an inspection function for a radio-frequency connector, and in particular to provide a protective cap having an inspection function for a small-Din type (Mini-Din type) radio-frequency connector; the protective cap is capable of enabling the mounting personnel to quickly distinguish which type of connector a jumper port offers, and therefore, incorrect mounting and scrapping of products can be avoided.

The protective cap of the present invention may not only have a connector protecting function of a common protective cap but may also have a function of inspecting and distinguishing two or more types of different connector interfaces.

To achieve the above purpose, embodiments of the present invention are directed to a protective cap for a radio-frequency connector. The radio-frequency connector includes a plug connecting piece and a socket connecting piece, and the protective cap can be removably mounted to the socket connecting piece for protection. The protective cap is characterized by including: a protection part structured to engage with the socket connecting piece; and an inspection part structured to only allow a matched plug connecting piece to be inserted in. Hence, the inspection part can be used for inspecting a specific type of the plug connecting piece.

The radio-frequency connector may be a Mini-Din type radio-frequency connector.

The Mini-Din type radio-frequency connector may be a 4.1/9.5 type or 4.3/10.0 type radio-frequency connector.

The inspection part may comprises a coaxial hollow cylinder area, and the size of the hollow cylinder area may be selected to match with the size of the matched plug connecting piece.

The protection part may be structured to be in threaded engagement with the socket connecting piece.

The protective cap may be formed integrally by the protection part and the inspection part.

The protective cap may be made of rigid plastic, such as PE, or a metal, such as copper or aluminum.

Embodiments of the invention are also directed to a radio-frequency connector, which includes a plug connecting piece and a socket connecting piece and is characterized in that the above-mentioned protective cap can be used for protecting the radio-frequency connector.

Embodiments of the invention are also directed to a method using the above-mentioned protective cap with a radio-frequency connector, comprising the following steps: when an antenna leaves out of the factory, the protective cap is mounted on a socket connecting piece of a radio-frequency connector at an antenna end; when the antenna is mounted, the mounting personnel carries out a matching judgment on the type of a plug connecting piece of the radio-frequency connector by using the protective cap, and only when the plug connecting piece can be inserted into the inspection part of the protective cap, the plug connecting piece is the matched plug connecting piece that can be correctly connected with the socket connecting piece; and after the matched plug connecting piece is judged, the protective cap is removed and then the antenna is further mounted.

BRIEF DESCRIPTION OF THE DRAWINGS

Various goals, features and advantages of the present invention will be more apparent by considering the following detailed descriptions of preferred embodiments thereof in combination with the accompanying drawings. The accompanying drawings are merely exemplary illustrations of the present invention, and not certainly scaled. Same reference signs represent the same or similar components throughout the accompanying drawings.

DETAILED DESCRIPTION OF THE EMBODIMENTS

The embodiments of a protective cap having an inspection function for a radio-frequency connector according to the present invention are described with reference to the accompanying drawings. The description contents and the accompanying drawings are merely exemplary rather than limiting the protection scope of claims attached in any way.

Unless otherwise defined, all technical and scientific terms that are used in this disclosure have the same meaning as commonly understood by one of ordinary skill in the art to which this invention belongs. The terminology used in the below description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., an assembly, a housing, a cable, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

In the following descriptions of embodiments of the present invention, the protective cap is used for inspecting the adaptability of the 4.1/9.5 type and 4.3/10.0 type radio-frequency connectors. However, it should be appreciated that it is merely exemplary. Actually, the protective cap for the radio-frequency connector according to the present invention is applicable to inspect and distinguish any two radio-frequency connectors similar in shape but different in internal assembly structure.

Figure 1:
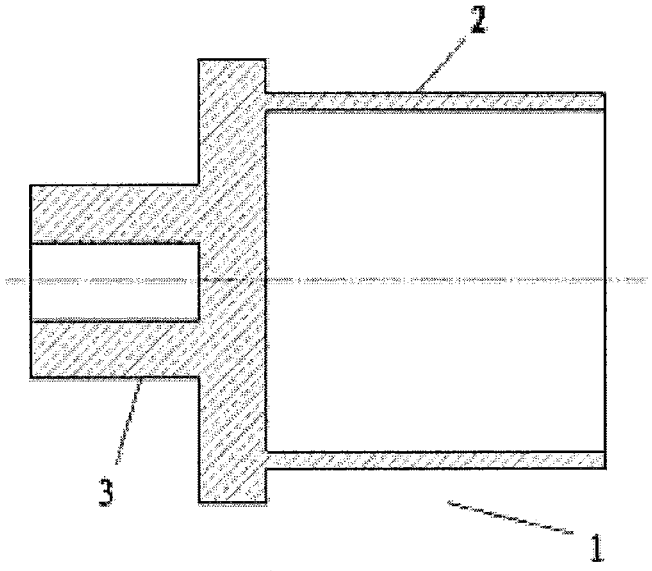
FIG. 1 is a sectional view of a protective cap made of rigid plastic for a radio-frequency connector according to an embodiment of the present invention.
Figure 2:
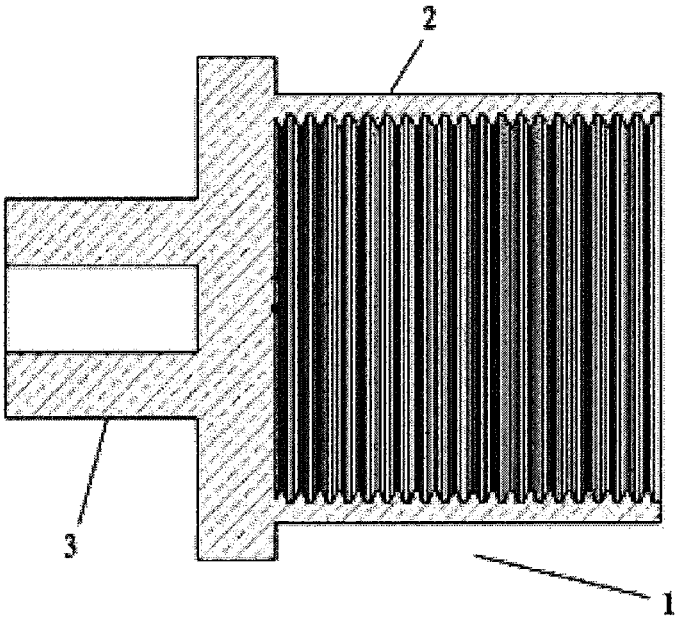
FIG. 2 is a sectional view of a protective cap made of a metal for a radio-frequency connector according to an embodiment of the present invention.

As shown in FIGS. 1 and 2, the protective cap 1 having the inspection function for the radio-frequency connector according to the present invention includes: a protection part 2 structured to engage with a socket connecting piece of the 4.3/10.0 type radio-frequency connector; and an inspection part 3 structured to only allow a plug connecting piece of the 4.3/10.0 type radio-frequency connector to be inserted within. Hence, the inspection part 3 can be used for inspecting and judging whether a plug connecting piece is the plug connecting piece of the 4.3/10.0 type radio-frequency connector.

When the 4.3/10.0 type radio-frequency connector is mounted on an antenna, the port of the mounted radio-frequency connector is a 4.3/10.0 type socket connecting piece and external threads thereof are standard M20*1.0 common threads. The protection part 2 of the protective cap 1 of the present invention contains a hollow cylinder area, and the size of the hollow cylinder area is set to match with the M20*1.0 standard external threads of the socket connecting piece of the 4.3/10.0 type radio-frequency connector. The inspection part 3 of the protective cap 1 includes a coaxial hollow cylinder area, and the size of the hollow cylinder area of the inspection part 3 is set to match with the size of the plug connecting piece of the 4.3/10.0 type radio-frequency connector. Specifically, the hollow cylinder of the inspection part 3 has a length of 10.0 mm, an outer diameter of 11.30 mm and an inner hole diameter of 4.5 mm.

The protective cap 1 may be made of rigid plastic, for example, PE, or a metal material, such as copper or aluminum. As shown in FIG. 1, when the protective cap 1 is made of rigid plastic, an inner hole of the cylindrical hollow end of the protection part 2 is a smooth cylinder, and the diameter of the inner hole is slightly smaller than the diameter of the M20*1.0 standard external threads, such that the inner hole may directly sleeve the socket connecting piece of the 4.3/10.0 type radio-frequency connector in a close fit manner. As shown in FIG. 2, when the protective cap 1 is made of the metal material, the inner hole of the cylindrical hollow end of the protection part 2 is standard M20*1.0 common internal threads and can be directly matched with the external threads of the socket connecting piece of the 4.3/10.0 type radio-frequency connector.

Figures 3A, 3B:
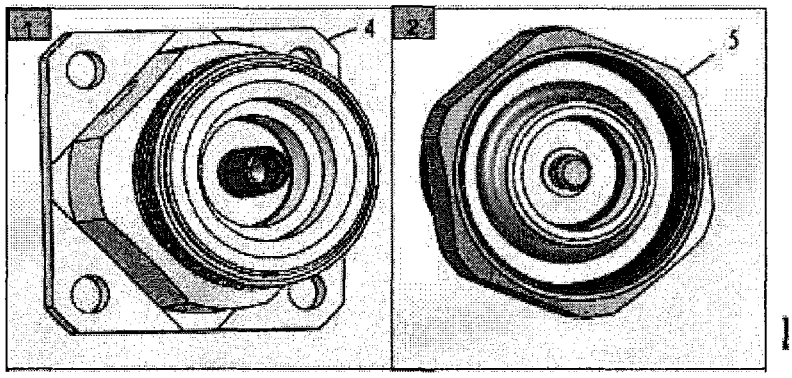
FIG. 3A is a schematic diagram of a socket connecting piece of the 4.1/9.5 type radio-frequency connector.
FIG. 3B is a schematic diagram of a plug connecting piece of the 4.1/9.5 type radio-frequency connector.
Figures 3C, 3D:
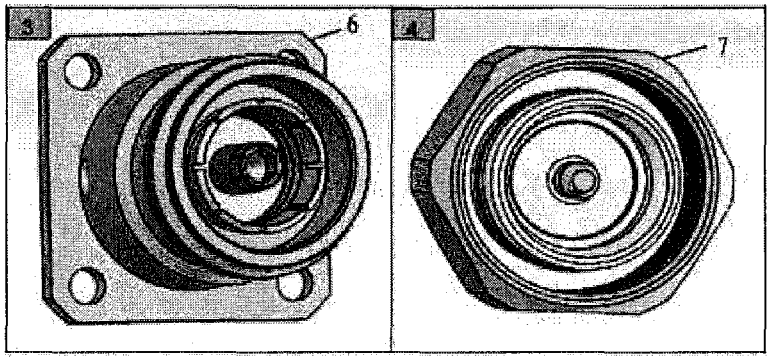
FIG. 3C is a schematic diagram of a socket connecting piece of the 4.3/10.0 type radio-frequency connector.
FIG. 3D is a schematic diagram of a plug connecting piece of the 4.3/10.0 type radio-frequency connector.

FIG. 3A is a schematic diagram of the socket connecting piece 4 of the 4.1/9.5 type radio-frequency connector, FIG. 3B is a schematic diagram of the plug connecting piece 5 of the 4.1/9.5 type radio-frequency connector, FIG. 3C is a schematic diagram of the socket connecting piece 6 of the 4.3/10.0 type radio-frequency connector, and FIG. 3D is a schematic diagram of the plug connecting piece 7 of the 4.3/10.0 type radio-frequency connector. It can be seen from FIG. 3A and FIG. 3C that the socket connecting piece 4 of the 4.1/9.5 type radio-frequency connector and the socket connecting piece 6 of the 4.3/10.0 type radio-frequency connector are easy to distinguish in shape, with a typical difference that the socket connecting piece 6 of the 4.3/10.0 type radio-frequency connector is provided with an inner grooved portion; however, the plug connecting pieces 5 and 7 of the two types are difficult to distinguish in shape with the naked eyes and substantially consistent with each other.

In practice that the socket connecting piece 4 of the 4.1/9.5 type radio-frequency connector is only capable of matching with the 4.1/9.5 type plug connecting piece 5, and the 4.3/10.0 type socket connecting piece 6 is capable of matching with either the 4.3/10.0 type plug connecting piece 7 or the 4.1/9.5 type plug connecting piece 5, but may cause damage to the inner grooved portion of the 4.3/10.0 type socket connecting piece 6 after it is matched with the 4.1/9.5 type plug connecting piece 5.

Figure 5:
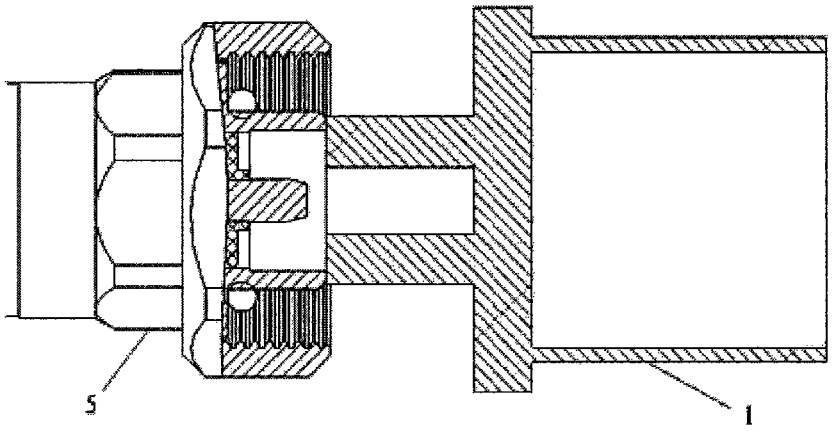
FIG. 5 is a sectional view of a protective cap being matched with a plug connecting piece of a 4.1/9.5 type radio-frequency connector.
Figure 6:
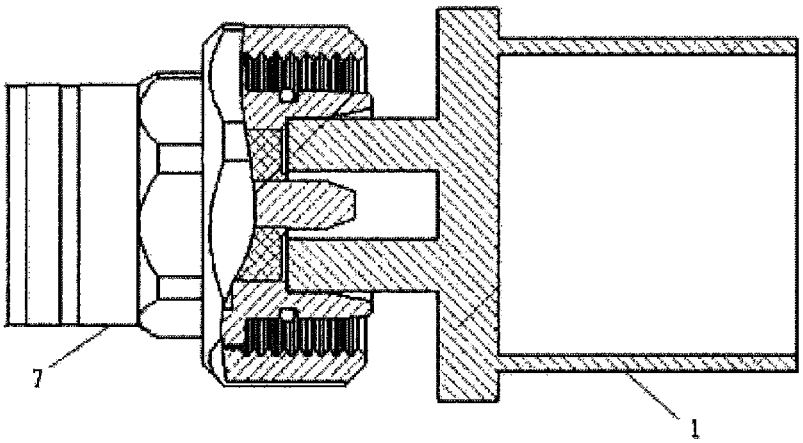
FIG. 6 is a sectional view of a protective cap being matched with a plug connecting piece of a 4.3/10.0 type radio-frequency connector.

The problem can be addressed by using the protective cap 1 with the inspection function for the radio-frequency connector according to the present invention. As shown in FIG. 5, when the protective cap 1 is matched with the 4.1/9.5 type plug connecting piece 5, as the size of the head of the 4.1/9.5 type plug connecting piece 5 is smaller than the size of the protective cap 1, the head is unable to be inserted into the protective cap 1, and therefore, it may be judged as mismatching As shown in FIG. 6, when the protective cap 1 is matched with the 4.3/10.0 type plug connecting piece 7, as the size of the head of the 4.3/10.0 type plug connecting piece 7 and the size of the protective cap 1 are configured such that the head is just able to go into the protective cap 1, and therefore, it may be judged as matching.

Figure 4:
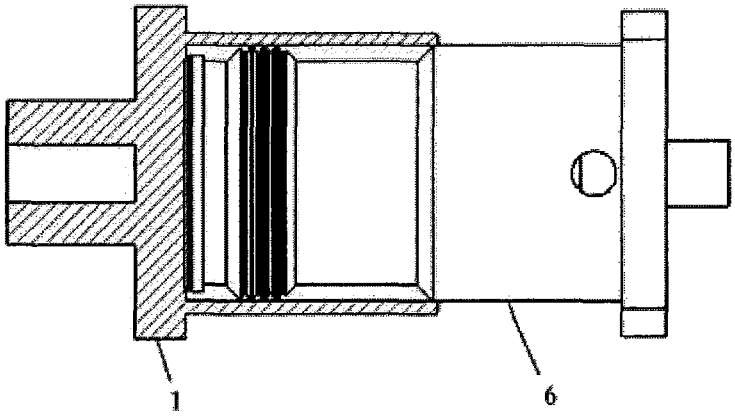
FIG. 4 is a sectional view of a protective cap for protecting a socket connecting piece of a 4.3/10.0 type radio-frequency connector.

An application method of the protective cap 1 comprises the following steps: as shown in FIG. 4, when an antenna exits the factory, the protective cap 1 is mounted on the socket connecting piece 6 of the 4.3/10.0 type radio-frequency connector at an antenna end; when the antenna is mounted, if the mounting personnel is unable to judge which type of radio-frequency connector the held plug connecting piece belongs to, the mounting personnel can carry out a matching judgment by using the protective cap 1 according to a judgment method as follows:

A. when the held plug connecting piece cannot be inserted into the inspection part 3 of the protective cap 1, the held plug connecting piece is the plug connecting piece 5 of the 4.1/9.5 type radio-frequency connector;

B. when the held plug connecting piece can be inserted into the inspection part 3 of the protective cap 1, the held plug connecting piece is the plug connecting piece 7 of the 4.3/10.0 type radio-frequency connector; After the plug connecting piece 7 of the 4.3/10.0 type radio-frequency connector is identified, the protective cap 1 can be removed and then the antenna is further mounted.

The protective cap 1 with the inspection function for the radio-frequency connector according to the above embodiments of the present invention is capable of providing the mounting operation personnel with a rapid and effective inspection/distinguishing tool aiming at the 4.3/10.0 type radio-frequency connectors, thereby avoiding product damage due to incorrect matching; in short, the protective cap 1 has an actual effective practical significance.

In the disclosure of the present invention with reference to some embodiments, various modifications and alterations can be made to the embodiments without departing from the range and scope of the present invention. Hence, it should be appreciated that the present invention is not limited to the described embodiments and the protection scope of the present invention should be defined by the contents of claims attached and equivalent structures and solutions thereof.

The invention claimed is:

1. A protective cap for a radio-frequency connector, wherein the radio-frequency connector includes a plug connecting piece and a socket connecting piece, the protective cap being removably mountable to the socket connecting piece for protection, the protective cap comprising: a protection part structured to engage with the socket connecting piece; and an inspection part structured to only allow a matched plug connecting piece to be inserted thereinin.

2. The protective cap of claim 1, wherein the radio-frequency connector is a Mini-Din type radio-frequency connector.

3. The protective cap of claim 2, wherein the Mini-Din type radio-frequency connector is a 4.1/9.5 type or 4.3/10.0 type radio-frequency connector.

4. The protective cap of claim 1, wherein the inspection part comprises a coaxial hollow cylinder area, and the size of the hollow cylinder area is set to match with the size of the matched plug connecting piece.

5. The protective cap of claim 1, wherein the protection part is structured to be in threaded engagement with the socket connecting piece.

6. The protective cap of claim 1, wherein the protective cap is formed integrally by the protection part and the inspection part.

7. The protective cap of claim 1, wherein the protective cap is made of rigid plastic or a metal.

8. The protective cap of claim 7, wherein the rigid plastics refer to a PE material, and the metal is copper or aluminum.

9. A radio-frequency connector, comprising a plug connecting piece and a socket connecting piece inc combination with the protective cap of claim 1 to protect the radio-frequency connector.

10. A method of applying the protective cap of claim 1 comprising the following steps:

when an antenna exits a factory, the protective cap is mounted on a socket connecting piece of a radio-frequency connector at an antenna end;

when the antenna is mounted, the mounting personnel carries out a matching judgment on the type of a plug connecting piece of the radio-frequency connector by using the protective cap, and only when the plug connecting piece can be inserted into the inspection part of the protective cap, the plug connecting piece is the matched plug connecting piece which can be correctly connected with the socket connecting piece; and after the matched plug connecting piece is judged, the protective cap is removed and then the antenna is further mounted.

11. A radio frequency socket, comprising:

a center contact;

an outer conductor body;

a spring basket with a plurality of fingers located between the center contact and the outer conductor body;

wherein the center conductor, the outer conductor body and the spring basket conform to the requirements of IEC 4.3/10; and a protective cap fitted over the outer conductor body, the cap including a cylindrical inspection portion, the inspection portion sized to fit within a mating 4.3/10 plug but not fit within a 4.1/9.5 plug.

12. The radio frequency socket defined in claim 11, wherein the inspection portion has an outer diameter of 11.3 mm.

13. The radio frequency socket defined in claim 12, wherein the inspection portion has an inner diameter of 4.5 mm.

14. The radio frequency socket defined in claim 13, wherein the inspection portion has a length of 10 mm.

15. A method of interconnecting a 4.3/10 interface, comprising the steps of:

providing a 4.3/10 radio frequency socket defined in claim 11;

(b) engaging the inspection portion of the cap with a radio frequency plug to attempt to insert the plug onto the cap;

(c) if the inspection portion of the cap fits within the plug upon attempted insertion, removing the cap from the socket and interconnecting the plug with the socket; or (d) if the inspection portion of the cap does not fit within the plug upon attempted insertion, retaining the cap on the socket.

* * * * *